US005975182A

United States Patent [19]

Hartmann et al.

[11] Patent Number: 5,975,182

[45] Date of Patent: Nov. 2, 1999

[54] APPARATUS FOR PROCESSING FOLDED PRINTED SHEETS

[75] Inventors: Rolf Hartmann, Dornach; Daniel Langenegger, Brittnau, both of Switzerland

[73] Assignee: Grapha-Holding AG, Hergiswil, Switzerland

[21] Appl. No.: 08/888,874

[22] Filed: Jul. 7, 1997

[30] Foreign Application Priority Data

Jul. 19, 1996 [CH] Switzerland ..... 1813/96

[51] Int. Cl.[6] ..... B65H 39/06

[52] U.S. Cl. ..... 156/538; 270/52.3; 270/58.08

[58] Field of Search ..... 156/538; 270/52.3, 270/58.08

[56] References Cited

U.S. PATENT DOCUMENTS

| | | | |
|---|---|---|---|
| 5,277,413 | 1/1994 | Boss | 270/52.3 |
| 5,417,410 | 5/1995 | Meier | 270/58.08 |
| 5,810,345 | 9/1998 | Lehmann et al. | 270/52.26 |

FOREIGN PATENT DOCUMENTS

| | | |
|---|---|---|
| 0 551 055 A2 | 12/1992 | European Pat. Off. . |
| 0 551 055 | 7/1993 | European Pat. Off. . |
| 0 681 923 A1 | 4/1995 | European Pat. Off. . |
| 0 681 923 | 11/1995 | European Pat. Off. . |
| 196 38 48 A1 | 5/1997 | Germany . |
| 408 065 | 9/1966 | Switzerland . |

*Primary Examiner*—Richard Crispino
*Assistant Examiner*—Robert R. Koehler
*Attorney, Agent, or Firm*—Darby & Darby

[57] ABSTRACT

An apparatus for the processing of folded printed sheets is provided with at least one work station located next to a conveying path, with the work station preferably being a feeder for separating and opening the printed sheets. A plurality of support means is arranged sequentially on conveying means configured as a continuous loop, with the printed sheets in the region of the fold slidingly supportable on a respective support edge of the respective support means. The support means are spaced apart and sequentially guided past the work station and are inclined with respect to the conveying direction of the conveying means at least in the region of a work station.

12 Claims, 2 Drawing Sheets

APPARATUS FOR PROCESSING FOLDED PRINTED SHEETS

BACKGROUND OF THE INVENTION

1. Field of the Invention

The present invention relates to an apparatus for processing folded printed sheets including at least one work station arranged at a conveying path. One of the at least one work station is a feeder station for separating and opening the printed sheets. Conveying means are configured in a continuous loop and a plurality of support means are arranged sequentially along the conveying means. The plurality of support means are supplied by the feeder for printed sheets. Each of the printed sheets includes a fold region which is slidingly supported at a respective support edge on the support means. The support means are spaced apart and are sequentially guided past the work station.

2. Description of the Related Art

A conventional apparatus of this type is known from EP-A-0 551 055, also owned by the assignee of the present application. The apparatus provides for collecting and subsequently stitching of printed matter. Before being stitched, the printed matter is spread apart and transferred to a conveying device having receiving rungs extending transversely to the transport direction.

Another gather-stitcher is shown in EP-A-0 681 923. Here, the supporting edges of the support means extend parallel to the transport direction.

The process for removing folded paper sheets from a stack and placing those sheets onto a transport device is well known, see, for example, the 1961 reference CH-A-408 065.

Devices of this type with support means extending transversely to the transport direction, however, did not succeed in practical applications. The reason for this lack of success is, that the feeding of the paper stock is quite complicated. On the other hand, devices with support means which extend parallel to the transport direction, have proven successful in practical applications. However, with those devices, limitations exist with respect to further increasing the transport speed and thereby the efficiency.

SUMMARY OF THE INVENTION

It is the object of the invention to provide an apparatus of the described type which simplifies the process of feeding the printed sheets, while at the same time permitting a higher efficiency.

The object of the apparatus of this type is obtained by inclining the support edges of the support means with respect to the conveying direction of the conveying means at least in the region of a work station.

With the configuration of the invention, the apparatus can attain a higher efficiency at the same transport velocity when compared to the apparatus with a longitudinal transport described in EP-A-0 681 923, since the printed sheets can be arrayed with a tighter spacing therebetween. Since the support edges are inclined with respect to the conveying direction of the conveying means, the support means can be fed in a much simpler fashion. The invention thus simplifies, on one hand, the feeding process and increases, on the other hand, the efficiency.

A stitching station as well as a card gluing device can also be easily integrated with the apparatus of the invention.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
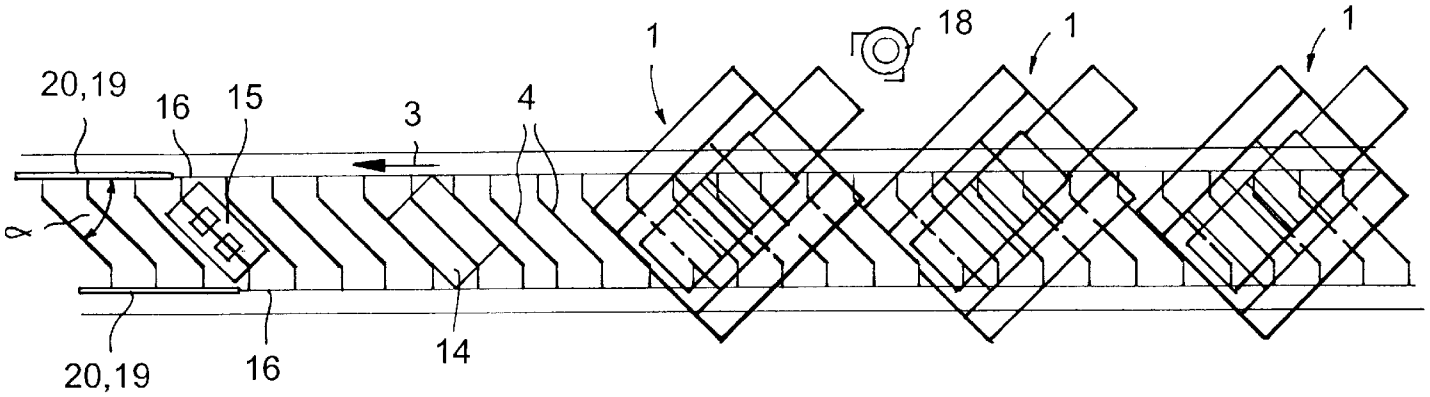
FIG. 1 is a schematic top view of an apparatus of the invention.
Figure 2:
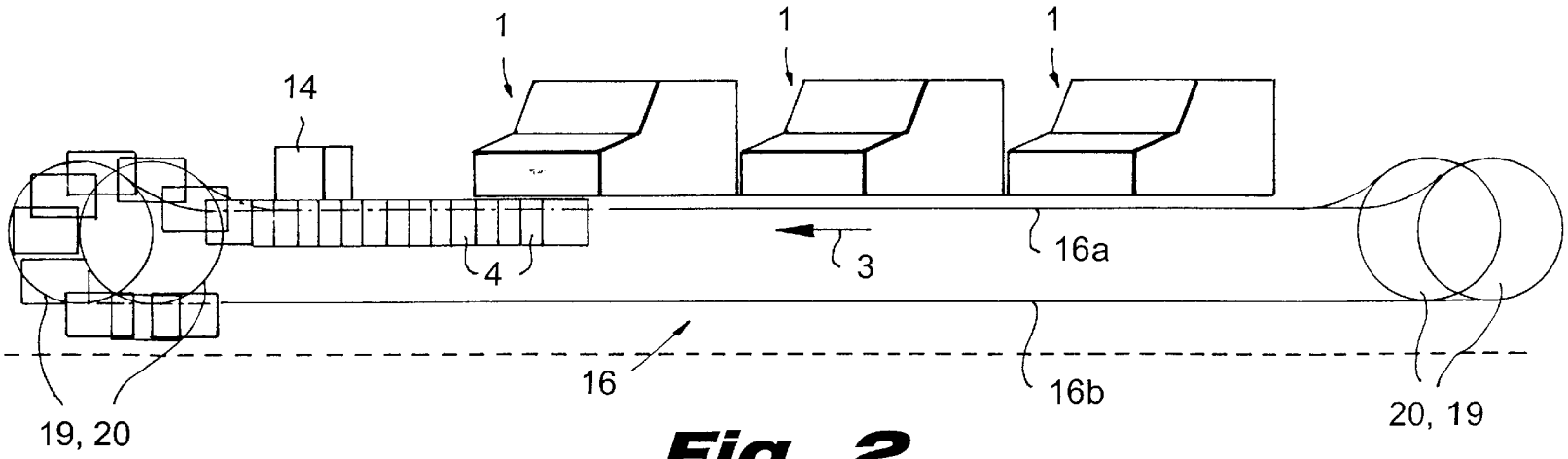
FIG. 2 is a schematic side view of the apparatus of FIG. 1.
Figure 3:
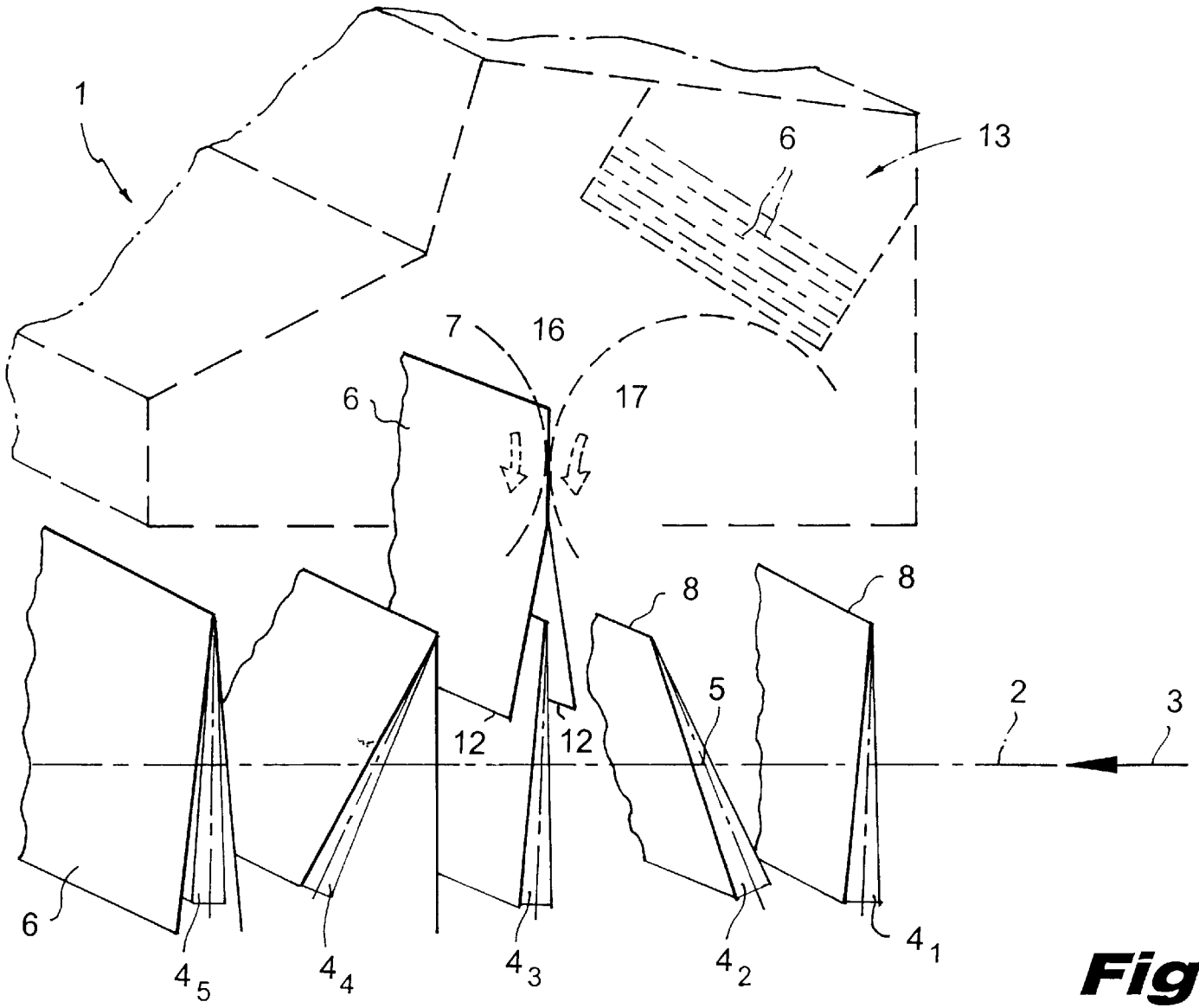
FIG. 3 is a schematic partial view of the apparatus of the invention.

Referring now to the FIGS. 1–3, the apparatus of the invention is provided with a plurality of feeders 1 for individually opening printed sheets 6, each having a folded edge 7 and an open edge 12, that are provided by a stacking magazine 13 with the aid of counter-rotating opening means 17*a* and 17*b*. The opened sheets 6 are placed onto saddle-shaped support means 4, as shown in FIG. 3. The saddle-shaped support means 4 are pivotally supported by conveying means 16 via swivel pins 5 (shown only schematically). The upper end of each support 4 is provided with a horizontally extending support edge 8 adapted to receive a printed sheet 6 folded in the center, as depicted by the saddle-shaped support $\mathbf{4}_5$ on the leftmost side of FIG. 3. As seen from FIG. 3, in the receiving area for the printed sheets, the support means $\mathbf{4}_1$–$\mathbf{4}_5$ and their support edges 8 are first tilted in the same direction as the transport direction and subsequently tilted in the direction opposite to the transport direction. The transport direction is indicated by the arrow 3. The drive energy for the tilt motion can be derived from the conveying means 16 through a crank drive (not shown). By tilting the support means 4, the relative velocity of the support edges in the region cooperating with the feeder 1 for the printed sheets can be decreased to a value of 0, which simplifies the design of the elements acting on the support means 4. Reference is made here to the U.S. Pat. No. 5,810,345. The text of this patent is incorporated herein by reference.

As shown with particularity in FIG. 1, the saddle-shaped support means 4 as well as the support edges 8 are inclined with respect to the conveying path 2. In conformity with this oblique orientation, the feeders 1 are also inclined with respect to the conveying path 2. The stacking magazines 13 are then arranged such that an operator 18 is able to replenish the stacking magazines 13 while standing close to the side of the apparatus, as shown in FIG. 1. The operator 18 can be replaced by an automatic replenishing device. In an apparatus with support edges extending transversely to the conveying path 2, an automatic replenishing device of this type would have to be provided with expensive deflection means.

The conveying means 16, which transports the support means 4 in the direction of the arrow 3, is provided with two deflection rollers 20, and two drive rollers 19, respectively. According to FIGS. 1 and 2, each of these rollers 19 and 20 is displaced in the direction of the arrow 3, matching to the tilt of the support means 4. Each support edge 8 (as shown in FIG. 3) is part of a support means 4 (as shown in FIG. 1)

and is inclined by an angle α with respect to the conveying direction 3 at least in the region of at least one work station. The angle α indicated in FIG. 1 is greater than 0° and less than 90°. Preferably, the angle is between 30° and 60°. Most preferably, this angle is approximately 45°.

It is also contemplated to improve the feed operation by constructing the support means 4 so that they can be first raised and then lowered for the feeding operation.

In the illustrated embodiment, the feeders 1 for the printed sheets feed the support means in a direction transverse to the support edges. Conceivable, however, is also an embodiment wherein the support means 4 are fed parallel to the support edges. In such a parallel feed operation, the feeders for the printed sheets can be placed along the sides of the conveying means 16, thereby making it easier for an operator or an automatic device to replenish the stack.

In order for the support means 4 to be able to guide round the rollers 19 and 20, the separation between adjacent support means 4 has to be somewhat greater than the height of these support means. Preferably, the support means 4 are inclined with respect to the conveying path 2 in the region of the upper elevation 16*a* and also in the region of the lower elevation 16*b*. In principle, however, the oblique orientation is of foremost importance in the region of the feeders 1; in the region of the card gluing device 14 or of a stitching station 15, the support means 4 can also be oriented perpendicular to the conveying direction 3.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for processing folded printed sheets comprising at least one work station arranged along a conveying path having a conveying direction, the at least one work station includes a printed sheet feeder for separating and opening the folded printed sheets, each folded printing sheet includes a folded edge and an open edge;

conveyor configured such as to form a continuous loop;

a plurality of saddle-shaped supports, each having on one end a support edge, and being supplied with printed sheets by the printed sheet feeder, and each saddle-support being spaced apart and arranged sequentially on the conveyor; each of the printed sheets being slidingly supportable by the respective support edge of the respective saddle-shaped supports at the folded edge; and whereby each support edge is inclined by an angle (α) with respect to the conveying direction at least in the region of the at least one work station.

2. The apparatus according to claim 1, wherein the angle (α) is between about 30° and 60°.

3. The apparatus according to claim 2, wherein the angle (α) is about 45°.

4. The apparatus according to claim 3, wherein each of the folded printed sheets is opened separately by the printed sheet feeder at the open edge and placed onto the respective saddle-shaped support along the feed direction which is arranged in an inclining manner with respect to the conveying direction.

5. The apparatus according to claim 4, wherein the saddle-shaped supports are fed substantially parallel to the direction of the support edges.

6. The apparatus according to claim 4, wherein the printed sheet feeder feeds the saddle-shaped supports perpendicular to the support edges.

7. The apparatus according to claim 6, wherein the printed sheet feeder is disposed laterally proximate to the conveying path.

8. The apparatus according to claim 7, wherein each of the saddle-shaped supports is pivotally supported on the conveying means.

9. The apparatus according to claim 8, wherein during the feeding operation the saddle-shaped supports are both tilted in and opposite to the conveying direction of the conveying means.

10. The apparatus according to claim 9, wherein the saddle-shaped supports are capable of being lifted.

11. The apparatus according to claim 9, wherein the at least one work station includes a stitching device for stitching the printed sheets.

12. The apparatus according to claim 11, wherein the adjacent saddle shaped support are separated apart further than their respective height.

* * * * *